US009169667B1

(12) United States Patent
O'Neill

(10) Patent No.: US 9,169,667 B1
(45) Date of Patent: Oct. 27, 2015

(54) REKEYING TOOL FOR A LOCK

(71) Applicant: Louis A. O'Neill, Girard, OH (US)

(72) Inventor: Louis A. O'Neill, Girard, OH (US)

( * ) Notice: Subject to any disclaimer, the term of this patent is extended or adjusted under 35 U.S.C. 154(b) by 369 days.

(21) Appl. No.: 13/867,222

(22) Filed: Apr. 22, 2013

Related U.S. Application Data

(60) Provisional application No. 61/654,128, filed on Jun. 1, 2012.

(51) Int. Cl.
*E05B 17/00* (2006.01)
*E05B 19/20* (2006.01)

(52) U.S. Cl.
CPC ..... *E05B 17/0004* (2013.01); *E05B 19/20* (2013.01)

(58) Field of Classification Search
CPC ... E05B 19/20; E05B 17/0004; E05B 85/085; E05B 9/04; E05B 63/003; E05B 63/0056; E05B 63/0034; B25B 33/00
See application file for complete search history.

(56) References Cited

U.S. PATENT DOCUMENTS

| | | | | |
|---|---|---|---|---|
| 2,660,082 | A * | 11/1953 | Dreese | 81/185 |
| 2,741,907 | A | 4/1956 | Genender et al. | |
| 2,774,133 | A | 12/1956 | Sitz | |
| 3,218,699 | A | 11/1965 | Maese | |
| 3,664,007 | A | 5/1972 | Schlage | |
| 3,816,899 | A | 6/1974 | Kitts | |
| 4,142,391 | A | 3/1979 | Paig | |
| 4,305,314 | A | 12/1981 | Simpson | |
| 4,372,139 | A | 2/1983 | Laake | |
| 4,667,494 | A | 5/1987 | Joosten | |
| 4,675,994 | A | 6/1987 | Detloff | |
| 4,680,860 | A | 7/1987 | Detloff | |
| 4,763,395 | A | 8/1988 | Fontaine | |
| 5,121,618 | A * | 6/1992 | Scott | 70/367 |
| 5,325,690 | A | 7/1994 | Adler et al. | |
| 5,450,662 | A | 9/1995 | Watts | |
| 5,628,109 | A * | 5/1997 | Neuman | 29/804 |
| 5,921,456 | A * | 7/1999 | Kirsch et al. | 227/147 |
| 6,021,655 | A | 2/2000 | Labbe et al. | |
| 6,386,006 | B1 * | 5/2002 | DeWalch | 70/34 |
| 7,533,550 | B2 | 5/2009 | Herdman | |
| 7,685,852 | B2 | 3/2010 | Komemi | |
| 8,099,988 | B1 | 1/2012 | Wheatland | |
| 2009/0031774 | A1 | 2/2009 | Armstrong et al. | |

* cited by examiner

*Primary Examiner* — Robert Scruggs
(74) *Attorney, Agent, or Firm* — Roth Blair Roberts Strasfeld & Lodge

(57) ABSTRACT

A rekeying tool for a lock having a lock body, cylinder, upper and lower tumbler pins and upper springs, includes a cylindrically elongated follower having opposing ends. At least one of the ends is hollow and has a V-shaped or U-shaped groove. A cylindrically elongated solid piston having a corresponding V-shaped or U-shaped groove at an end is resiliently positioned in the hollow end of the follower. The solid piston includes a cut-through channel and a pin. The pin extends a cross-section of the hollow end of the follower and passing though the cut-through channel to guide reciprocating travel of the piston from an inwardmost position to an outwardmost extension. The V-shaped or U-shaped groove of the solid piston is substantially aligned with the corresponding V-shaped or U-shaped groove of the hollow end of the follower when the piston is at the outwardmost extension.

6 Claims, 4 Drawing Sheets

REKEYING TOOL FOR A LOCK

This patent application claims priority under 35 U.S.C. § 119 to U.S. Provisional Patent Application Ser. No. 61/654,128 filed on Jun. 1, 2012, which is incorporated herein by reference in its entirety.

FIELD OF THE INVENTION

This present invention relates generally to a lock and, more particularly, to a lock rekeying tool for effectively inspecting, maintaining and rekeying the pins and springs within a lock assembly having a lock cylinder and lock body.

BACKGROUND OF THE INVENTION

This invention relates to a rekeying tool for a lock assembly, shown in FIG. 1, for example, having a lock body with a locking cylinder rotatably alignable therein. The locking cylinder includes a plurality of radially extending bores (typically five to six) alignable with mating bores in the lock body. Each bore in the lock body includes an upper pin and corresponding spring biasing the upper pin toward an axially aligned lower tumbler pin in the corresponding mating bore of the locking cylinder. Further describing the bores in the locking cylinder body, each is perpendicular to and aligned in a row along the cylinder's axis.

Locks of this type tend to wear, particularly on the contact surfaces of the pins. For example, the pins in the locking cylinder are constantly rubbed by the key to adjust the position of the pins so that the cylinder may be turned within the lock body. The rubbing causes wear and eventually lock failure. This problem is often corrected by replacing the tumbler pins within the rotatable cylinder. Still further, select tumbler pins are replaced with pins of different length when rekeying the lock.

A problem is presented when rekeying or maintaining a lock, in that, when the lock cylinder is removed from the lock body, the upper pins, which remain disposed within bores in the lock body, are not positively maintained in position, and, since the same are resiliently urged into the space formally occupied by the cylinder, the upper pins and springs become dislodged from the bores in which they were originally positioned; therefore, necessitating the repositioning of the same before the lock is reassembled.

Since the upper pins positioned in the lock body do not wear, as do the lower tumbler pins, upper pins are not typically replaced with new pins. Therefore, there is often no reason for their removal when replacing the lower tumbler pins. However, the springs may sometimes need maintained and replaced if the spring force is damaged or worn with use. Still further, the pins in both the lock body and lock cylinder are relatively small in size, and the same are not readily repositioned without considerable effort on the part of the locksmith. As a result, the process of inspecting, maintaining and/or rekeying a lock is intricate, requires careful skill, and often time consuming.

The use of various lock servicing tools is known and includes different lock servicing devices as those shown in U.S. Pat. No. 5,628,109 issued May 13, 1997 to Martin Newman; U.S. Pat. No. 4,680,860 issued Jul. 21, 1987 to John C. Detloff; U.S. Pat. No. 4,675,994 issued Jun. 30, 1987 to John C. Detloff; U.S. Pat. No. 4,305,314 issued Dec. 15, 1981 to Ernest I. Simpson; U.S. Pat. No. 3,816,899 issued Jun. 18, 1974 to George J. Kitts; and U.S. Pat. No. 3,664,007 issued May 23, 1972 to Ernest L. Schlage.

While these devices may accomplish their particular objective, the aforementioned patents do not disclose a single-unit, lock rekeying tool made and used to more effectively inspect, maintain and retool the pins within locking cylinders having a tail extension. Moreover, various lock assemblies have differently designed lock bodies and cylinders. Some lock cylinders have various tail extensions. Therefore, multiple tools and steps are required to prevent the tumbler pins and springs from being dislodged while removing these types of locking cylinders. When rekeying or servicing such locks, the tail extension must be removed or two tools are needed to slide the locking cylinder from the lock body: a hollow tool and a solid tool. The locksmith must work with both tools interchangeably to gain access to the small pins and springs of the lock assembly.

More specifically, the first tool (i.e., having a hollow cross-section) is used to encase the tail extension. Otherwise, on account of the changing configuration and outside diameter of the locking cylinder (particularly at the transition between the tail extension and actual cylinder housing) pins and springs could easily dislodge as the cylinder is being guided from the locking cylinder. To make repairs and/or rekey the lock, a second tool (i.e., having a solid cross-section) is slid behind the hollow tool. The second tool is needed to better manipulate, repair and/or replace the several paired spring and pin combinations in the mating bores of the lock body. Finally, to re-assemble the locking cylinder in the lock body, the task is reversed (i.e., changing from the second tool back to the first tool) to slide the locking cylinder back in place in the assembly.

SUMMARY OF THE INVENTION

The purpose of the instant invention is to eliminate the need for two separate tools. The instant invention uniquely combines both the hollow and solid tools into a single tool, thereby allowing the user to eliminate steps and need to switch between the different tools.

Accordingly, the rekeying tool in this invention includes a cylindrically elongated follower having opposing ends. At least one of the ends is hollow and has a V-shaped or U-shaped groove. A cylindrically elongated solid piston having a corresponding V-shaped or U-shaped groove at an end is resiliently positioned in the hollow end of the follower. The solid piston includes a cut-through channel and a pin. The pin extends a cross-section of the hollow end of the follower and passes through the cut-through channel to guide reciprocating travel of the piston from an inwardmost position to an outwardmost extension. The V-shaped or U-shaped groove of the solid piston is substantially aligned with the corresponding V-shaped or U-shaped groove of the hollow end of the follower when the piston is at the outwardmost extension.

Thus, it will be seen that, with the instant rekeying tool, the upper pins and spring of the lock body can be checked, and lower tumbler pins in the lock cylinder can be replaced without repeatedly switching between the hollow and solid tools. As a result, by using the instant rekeying tool, steps are eliminated in the rekeying and/or servicing process, thereby saving time, avoiding mistakes, and preventing aggravation.

DETAILED DESCRIPTION OF THE PREFERRED EMBODIMENT

Figure 1:
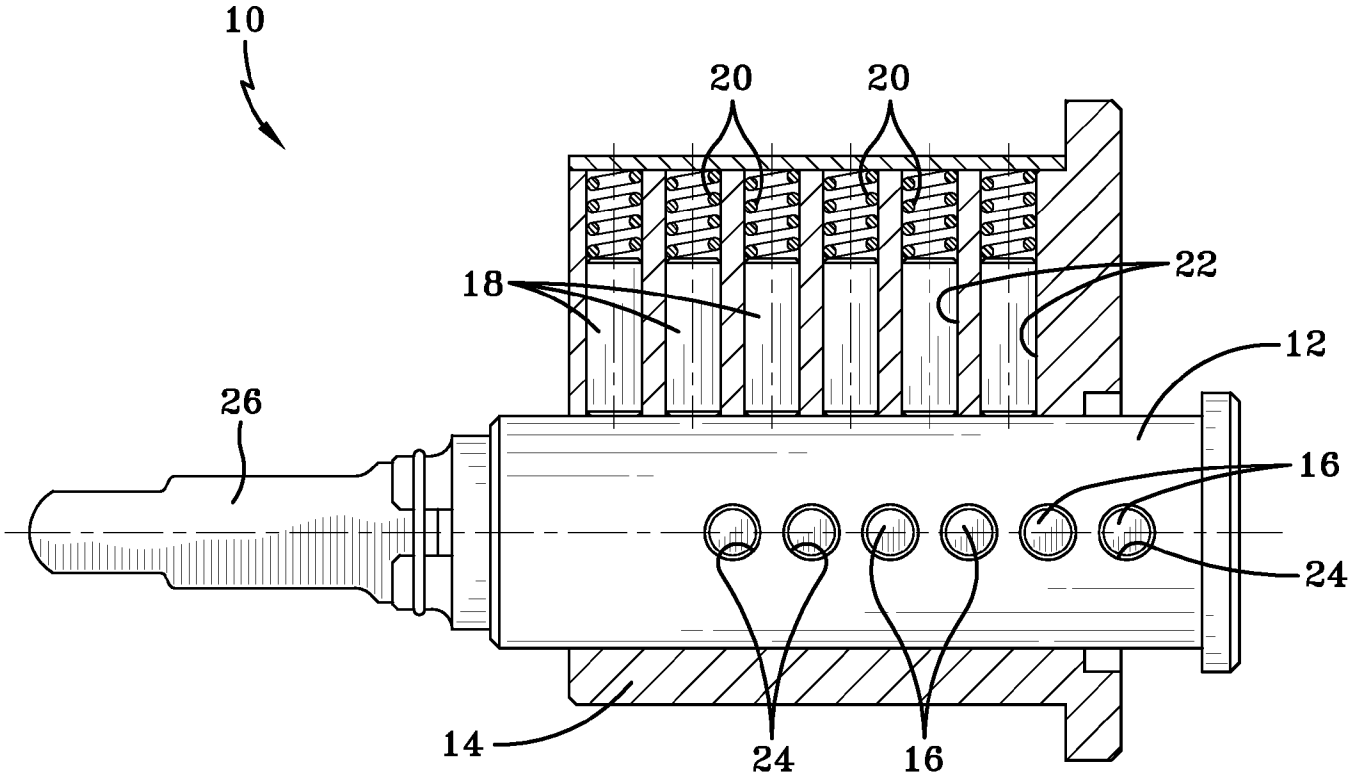
FIG-1 Prior Art
FIG. 1 is an enlarged, partially sectioned view, in an elevation, showing a standard type of pin tumbler lock with a locking cylinder or plug being slidably moved from the lock body.
Figure 2:
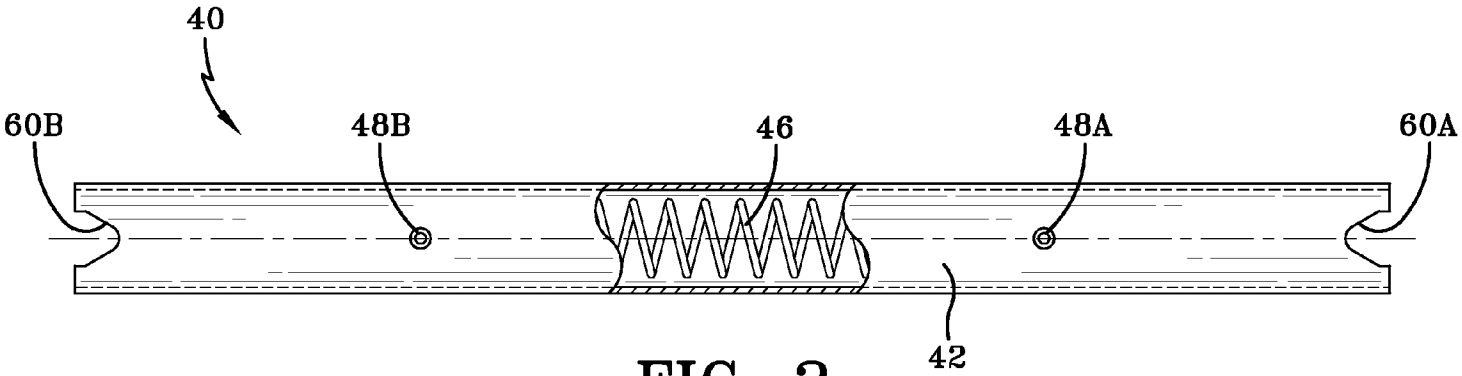
FIG. 2 illustrates a top plan and partial sectional view of a rekeying tool of the instant invention.
Figure 3:
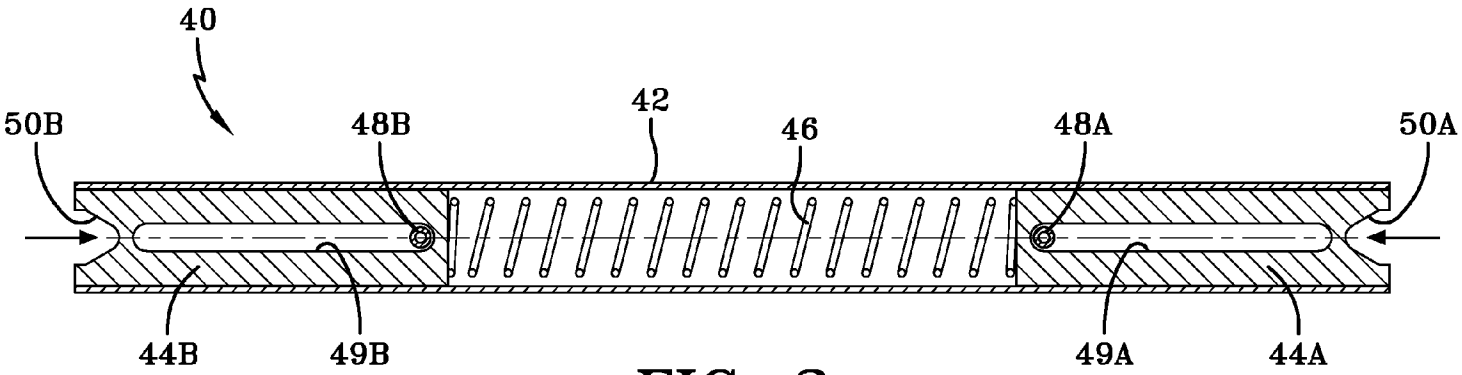
FIG. 3 illustrates a full sectional view of the rekeying tool with reference to FIG. 2.
Figure 4:
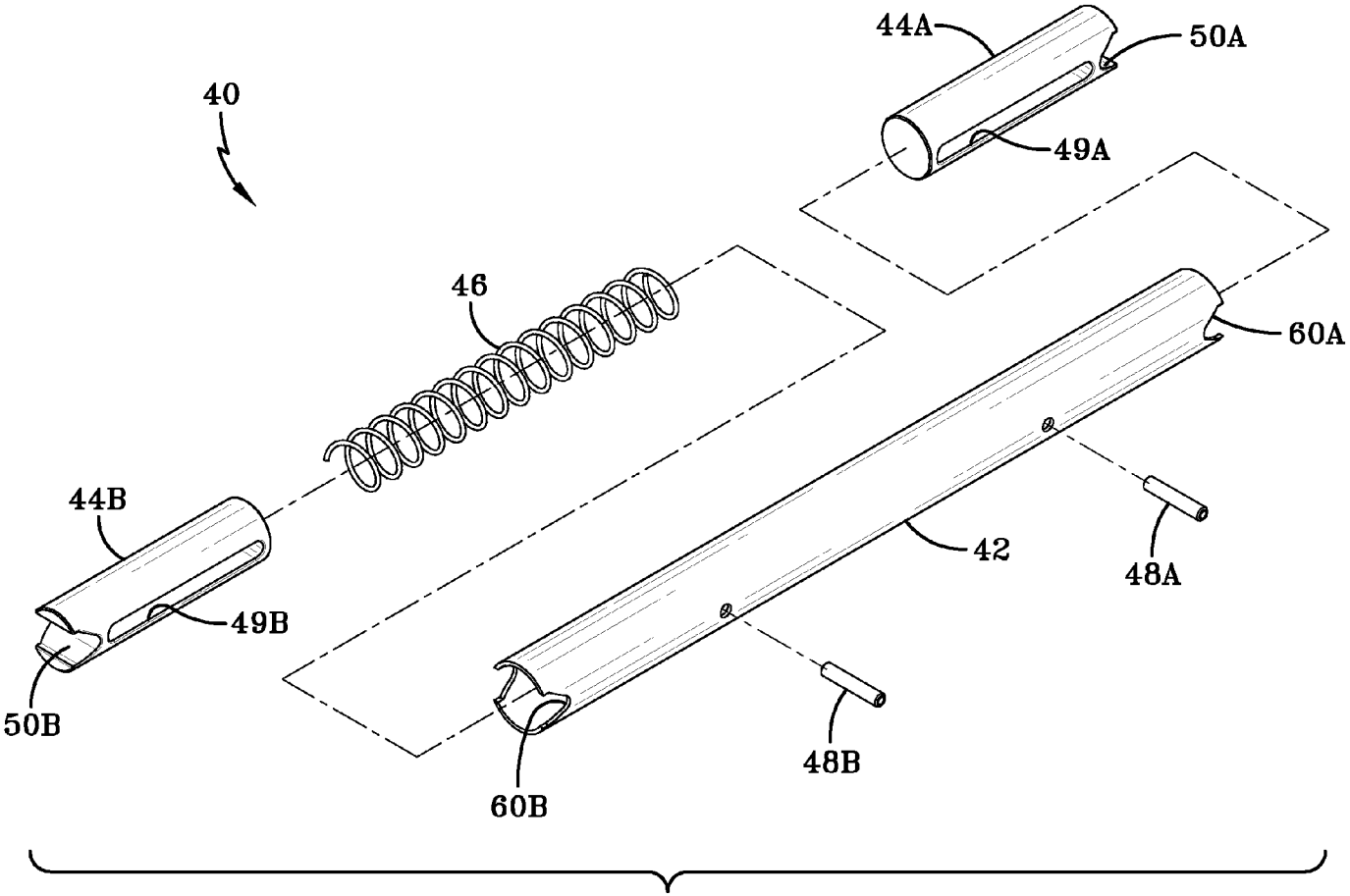
FIG. 4 is an exploded view of the rekeying tool.

With reference to FIGS. 2 through 5, a rekeying tool 40, in this case, includes an elongated hollow follower 42 which has substantially the same outside diameter and cylindrical shape as a locking cylinder or plug 12 of a lock assembly 10. Two pistons 44A, 44B are spring-biased within an inside diameter of the hollow follower 42. Each solid piston or inside follower 44A, 44B is positioned at and biased outward, at opposite ends of the hollow follower 42. The outermost end of each solid follower 44A, 44B has a V-shaped or U-shaped groove 50A, 50B extending longitudinally inward. More specifically, the wide opening of the groove 50A, 50B is at the very outer end of the solid follower 44A, 44B, respectively, and the groove progressively narrows inwardly. Each groove 50A, 50B is used as a vertical pin guide when checking and/or replacing the upper pins 18 and corresponding springs 20 in the lock body 14. A matching V-shaped or U-shaped groove 60A, 60B is formed at each opposing end of the hollow follower 42 of the rekeying tool 40 to shadow or conform to the corresponding V-shaped or U-shaped groove 50A, 50B of the corresponding solid followers 44A, 44B, when the solid followers are at its farthest (i.e., outwardmost) extended position, which is discussed further infra with reference to the in-and-out movement of each solid follower.

Each solid follower 44A, 44B includes a guide channel 49A, 49B cut along its longitudinal axis. A set screw or pin 48A, 48B, passes through one of the corresponding cut-out channels 49A, 49B to properly orient and reciprocally guide its respective solid follower 44A, 44B, inwardly and outwardly along the elongated axis of the hollow follower 42. The ends of the corresponding cut-through channel 49A, 49B act as stops along a traveling path (for an inwardmost position and an outwardmost extension of travel for each solid follower 44A, 44B). Further, each solid follower 44A, 44B is biased by one or more springs 46 pushing the solid followers outward, toward its corresponding outwardmost extension within the hollow follower 42 of the rekeying tool 40. When at its outwardmost extension, each V-shaped or U-shaped groove 50A, 50B of the corresponding solid follower 44A, 44B, respectively, is aligned with the corresponding V-shaped or U-shaped groove 60A, 60B of the hollow follower 42. Therefore, each set screw or pin 48A, 48B holds its corresponding solid follower 44A, 44B in position and acts as a limiting in-and-out guide.

As a result, the in-and-out reciprocating travel of solid followers 44A, 44B allows the rekeying tool 40 to adjustably fit different models of locking cylinder plugs 12. More specifically, in operation, the bias of each solid follower 44A, 44B allows it to collapse inside the hollow follower 42 of the rekeying tool 40, thereby allowing any tail extension 26 of the locking cylinder 12 to pass into the hollow follower 42.

Figure 5:
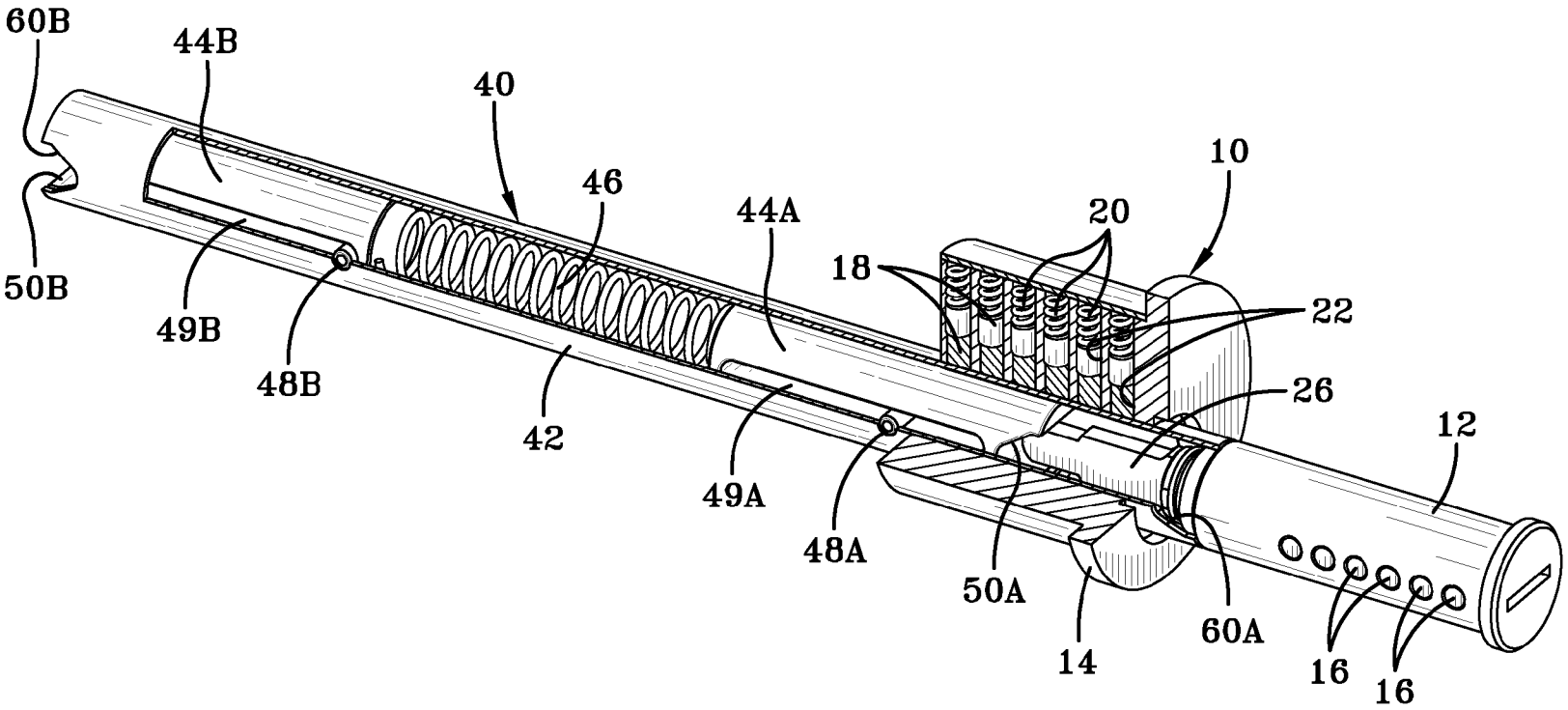
FIG. 5 is a partially sectioned perspective view illustrating the tail piece of the locking cylinder fit within a groove of one of the opposing, inside solid pistons or followers, and then inserted within the hollow follower as the rekeying tool replaces or is being replaced by the locking cylinder during disassembly and assembly, respectively.

In use, therefore, to avoid having to remove the tail extension 26 from the cylinder 12, the tail extension 26 of the locking cylinder 12 (which may have different lengths and shapes) is pushed against the solid follower 44A, 44B and into the hollow follower 42 of the rekeying tool 40 as best seen in FIG. 5. The locksmith then guides the rekeying tool 40 into the lock body 14 to push out and replace the locking cylinder 12 therewith.

Once the locking cylinder 12 is removed, the locksmith can rekey the lock by replacing the selected lower tumbler pins 16 in the locking cylinder 12. The locksmith can also service the lock body 14 by retracting the rekeying tool 40 to check and replace (if necessary) the springs 20 and upper pins 18 by using the corresponding V or U-shaped groove 50A or 50B of the respective solid follower 44A, 44B (now at its outwardmost extension) and the corresponding, aligned V or U-shaped groove 60A, 60B of the hollow follower 42 (which, in combination, form a pin guide as discussed supra).

After checking and replacing the pins 18 and springs 20 as needed, the locking cylinder 12 is reassembled with the lock body 14 by reversing the steps (i.e., axially aligning and inserting the tail extension 26 of the locking cylinder 12 with the hollow follower 42 and then slidably guiding the locking cylinder 12 back in place in the lock body 14). As the locking cylinder 12 is guided into the lock body 14, the rekeying tool 40 is simultaneously pulled out. Like the disassembly step of the process, the outer surface of the hollow follower 42 keeps the upper pins 18 and springs 20 from being dislodged as the locking cylinder 12 replaces the rekeying tool's position in this re-assembly step.

The newly developed rekeying tool described above should be understood to extend to any and all modifications, variations, adaptations, deviations and embodiments that would occur to one skilled in this technology, once having possessed the teachings of the present invention. Therefore, the present invention should be limited only by the claims.

What is claimed is:

1. A rekeying tool for a lock assembly having a lock body, cylinder, upper and lower tumbler pins and upper springs, the rekeying tool comprising:

a cylindrically elongated follower having opposing first and second ends, the first end being hollow and having a V-shaped or U-shaped groove;

a first cylindrically elongated solid piston being resiliently positioned in the first hollow end of the follower, the first piston having a cut-through channel and a V-shaped or U-shaped groove extending inward from an end of the first piston; and a first pin extending a cross-section of the first hollow end of the follower and passing though the cut-through channel of the first solid piston to guide reciprocating travel of the piston from a first inwardmost position to a first outwardmost extension, the V-shaped or U-shaped groove of the first solid piston being substantially aligned with the corresponding V-shaped or U-shaped groove of the first hollow end of the follower when the first piston is at the first outwardmost extension.

2. The tool in claim 1, wherein the first piston is resiliently biased by a spring in the follower engaging the first piston at an opposite end of the V-shaped or U-shaped groove of the first piston to force the first piston to the first outwardmost extension of travel.

3. The tool in claim 2, wherein the groove of the first piston has a depth at least equal to a length of an end portion of a tail extension of the lock cylinder.

4. The tool in claim 2, wherein a length of reciprocating travel of the first piston from the first inwardmost position to the first outwardmost extension is at least equal to an axial length of a tail extension of the lock cylinder.

5. The tool in claim 2, wherein the second end of the elongated follower is hollow and includes a V-shaped or U-shaped groove and further comprises:

a second cylindrically elongated solid piston resiliently positioned in the second hollow end of the follower having a V-shaped or U-shaped groove extending inward from an end of the second piston, the second piston having a cut-through channel;

a second pin extending a cross-section of the second end of the follower and passing though the cut-through channel in the second solid piston to guide reciprocating travel of the second piston from a second inwardmost position to a second outwardmost extension, the V-shaped or U-shaped groove of the second piston being substantially aligned with the corresponding V-shaped or U-shaped groove of the second end of the follower when the second piston is at the second outwardmost extension; and wherein the second piston is resiliently biased by the spring positioned at an opposite end of the V-shaped or U-shaped groove of the second piston to force the second piston in a direction opposite the bias of the first piston to the second outwardmost extension of travel.

6. A rekeying tool for a lock assembly having a lock body, cylinder, upper and lower tumbler pins, upper springs and tail extension, the rekeying tool comprising:

a cylindrically elongated follower having a hollow portion with a V-shaped or U-shaped groove at an end;

a cylindrically elongated solid piston positioned in the hollow portion of the follower, and the piston having a cut-through channel between first and second ends, the first end having a V-shaped or U-shaped groove extending inward and the second end engaging a spring confined in the hollow portion of the follower to resiliently bias the piston toward an outwardmost extension; and a first pin extending perpendicular through the hollow portion of the follower and passing though the cut-through channel in the piston to guide reciprocating travel of the piston a length from an inwardmost position toward the outwardmost extension, and the length of reciprocating travel of the first piston being at least equal to an axial length of the tail extension; and wherein the V-shaped or U-shaped groove of the solid piston being substantially aligned with the corresponding V-shaped or U-shaped groove of the follower when the piston is biased toward the outwardmost extension.

* * * * *